US008865283B2

(12) United States Patent
Ludwig et al.

(10) Patent No.: US 8,865,283 B2
(45) Date of Patent: Oct. 21, 2014

(54) SECURITY LABEL FOR SECURING MEDICATIONS RETAINED IN AN INDIVIDUAL PACKAGING

(75) Inventors: Frank Ludwig, Melsungen (DE); Reinhard Kuge, Melsungen (DE); Marco Dieling, Felsberg (DE)

(73) Assignee: Faubel & Co Nachfolger GmbH (DE)

( * ) Notice: Subject to any disclaimer, the term of this patent is extended or adjusted under 35 U.S.C. 154(b) by 310 days.

(21) Appl. No.: 13/394,479

(22) PCT Filed: Aug. 31, 2010

(86) PCT No.: PCT/DE2010/001022

§ 371 (c)(1), (2), (4) Date: Apr. 20, 2012

(87) PCT Pub. No.: WO2011/029421

PCT Pub. Date: Mar. 17, 2011

(65) Prior Publication Data

US 2012/0196072 A1 Aug. 2, 2012

(30) Foreign Application Priority Data

Sep. 8, 2009 (DE) ..... 20 2009 012 186 U

(51) Int. Cl.

| | |
|---|---|
| ***B65D 83/04*** | (2006.01) |
| ***G09F 3/03*** | (2006.01) |
| ***B65D 75/36*** | (2006.01) |
| ***G09F 3/00*** | (2006.01) |
| ***A61J 1/03*** | (2006.01) |

(52) U.S. Cl.

CPC ..... *G09F 3/0341* (2013.01); *B65D 75/367* (2013.01); *G09F 3/0292* (2013.01); *B65D 2575/367* (2013.01); *B65D 2575/3236* (2013.01); *B65D 2215/00* (2013.01); *A61J 1/035* (2013.01)

USPC ..... 428/43; 206/531; 206/532

(58) Field of Classification Search

CPC ..... B65D 2575/3236; B65D 2215/00; A61J 1/035

USPC ..... 428/43; 206/532, 531

See application file for complete search history.

(56) References Cited

U.S. PATENT DOCUMENTS

| | | | | |
|---|---|---|---|---|
| 3,759,371 | A * | 9/1973 | Marks | 206/531 |
| 2008/0073240 | A1* | 3/2008 | Bowers et al. | 206/532 |

FOREIGN PATENT DOCUMENTS

DE 10 2007 017856 A1 10/2008

OTHER PUBLICATIONS

International Search Report dated Jan. 12, 2011 issued in corresponding international patent application No. PCT/DE2010/001022.

*Primary Examiner* — Alexander Thomas

(74) *Attorney, Agent, or Firm* — Ostrolenk Faber LLP

(57) ABSTRACT

The present invention relates to a security label for securing medications retained in an individual packaging, comprising a base layer (10, 20, 30) that can be adhesively bonded to the individual packaging (12, 22, 32), wherein at least one opening cut (17, 37, 47, 57, 67, 77, 87, 97, 107, 117, 127, 137, 147, 157) per medication (16) is provided in the base layer (10, 20, 30) in the area of the expected medications (16), wherein the opening cut (17, 37, 47, 57, 67, 77, 87, 97, 107, 117, 127, 137, 147, 157) has at least one first and one second partial cut, and wherein the first partial cut and the second partial cut meet or cross, wherein two, three, four, or five opening cuts (17, 37, 47, 57, 67, 77, 87, 97, 107, 117, 127, 137, 147, 157) are provided in the area of the expected medication (16), and the opening cuts (17, 37, 47, 57, 67, 77, 87, 97, 107, 117, 127, 137, 147, 157); are arranged exclusively along a segment of the contour of the medication (16) or along a segment of the contour of the medication trough, wherein the segment makes up approximately one half to one sixth, preferably one fourth, of the contour.

9 Claims, 5 Drawing Sheets

SECURITY LABEL FOR SECURING MEDICATIONS RETAINED IN AN INDIVIDUAL PACKAGING

CROSS REFERENCE TO RELATED APPLICATIONS

The present application is a 35 U.S.C. §371 National Phase conversion of PCT/DE2010/001022, filed Aug. 31, 2010, which claims benefit of German Application No. 20 2009 012 186.0, filed Sep. 8, 2009, the disclosure of which is incorporated herein by reference.

BACKGROUND ON THE INVENTION

The present invention relates to a safety label for protecting medicaments contained in an individual packaging.

Blister packaging comprises a number of troughs, in which in each case one medicament is packaged using a covering film, typically made of aluminum. This covering film can be readily pierced, with the result that the medicament drops out or can be removed. As a result, there is a risk that the aluminum foil covering the medicaments also accidentally tears open and the medicament either becomes dirty, is lost, or is accessed by unauthorized persons, for example by small children. To protect such blister packaging, DE 10 2007 017 856 A1 proposes a label for attachment on blister packaging, which label comprises a base sheet, which is adhesively bondable to the blister packaging, and a cover sheet, which is adhesively bonded to the base sheet. This cover sheet is permanently adhesively bonded to the base sheet only in the region of its band, while the majority of the cover sheet sticks to the surface of the base sheet in a releasable and re-closable fashion owing to a varnish layer on the upper side of the base sheet. Provided in the base sheet in the region of the center point of the medicaments are longitudinal slits or cross slits, through which the individual medicament can be pushed in order to be removed. In another embodiment according to DE 10 2007 017 856 A1, a perforation is provided in a region surrounding the medicament, through which perforation the individual medicament is pushed in order to be removed.

It has been found that, among other things, the resistance encountered when the medicament is pushed out is still relatively low owing to the large longitudinal slits or cross slits or the perforation, with the result that the abovementioned object was only partially achieved.

SUMMARY OF THE INVENTION

Proceeding from this, the present invention is based on the object of providing a safety label of the type mentioned in the introduction, which safety label offers sufficient resistance when removing the medicament so as to offer protection against unauthorized opening by children or accidental opening.

As a technical way of achieving this object, the invention proposes a safety label of the type mentioned in the introduction.

A safety label configured according to this technical teaching has the advantage that the use of the opening cuts merely in one part portion of the medicament or medicament trough results in a closed protective layer remaining in the remaining portion, which protective layer cannot be pierced. In practice, this means that the user must realize that the medicament must be pushed through in the part portion provided with the openings, and not in the remaining, closed rest portion. This requires an intellectual maturity generally not yet present in small children. Without these considerations, only a small part of the medicament trough is available for the removal of the medicament, while the remaining part prevents removal, thus preventing small children from removing the medicament.

It also makes accidental opening more difficult, because in this case the location with the opening cuts needs to be encountered in the first place. At the same time, the patient is in a position to recognize that the medicament must be pushed out at that location in which the opening cuts are placed, so that the patient can readily remove the medicament.

Whether in the concrete case two, three, four or five opening cuts are present depends on the individual case, because the degree of difficulty and the resistance encountered when the medicament is pushed out can be adjusted by the number of opening cuts.

In one preferred embodiment, the opening portions are arranged equidistantly with respect to one another. This has the advantage that the corresponding opening portions in the respective part portion are distributed uniformly, with the result that, when viewed over the entire part portion, the same force needs to be applied in order to remove the medicament.

In one other preferred embodiment, the opening cuts are oriented radially with respect to their virtual center line. This ensures that the opening cuts remain in their part portion, for example in a quarter segment of a circle, and that for removing the medicament the resistance decreases in the direction of the center point, with the result that a medicament, once it is pushed through, can be removed in a simple manner.

In one further preferred embodiment, the opening cuts are arranged in a quarter of the contour, for example in a quarter segment of a circle, wherein the vertical portions of the opening cuts or the center points of the opening cuts are arranged on the edge of the quarter of the contour. This ensures that all opening cuts are located in this part portion and that only a quarter of the entire surface area is provided with opening cuts, while three quarters of the entire surface area are firmly closed.

In practice it has proven advantageous to configure the opening cut in the shape of a T, t, H, F, X, Y or a star. In the case of all these cuts, it is possible to pierce the safety label with a certain amount of applied force.

In one very preferred embodiment, the opening cuts are configured to be T-shaped and arranged with their first horizontal portion on the contour, preferably bearing tangentially against the contour, while the second, vertical portion of the T-shaped opening cut is oriented radially in the direction of the center of the medicament trough. This has the advantage that cuts are arranged along the contour and also that cuts are arranged in the radial direction. This makes it possible in a simple manner for the medicament to be pushed with its edge against the safety label, wherein the edge abuts near the contour and encounters a relatively low resistance there. If the medicament is pushed through further, the safety label then lifts up and the medicament can be removed.

A further advantage is that, owing to the opening cut being configured in the shape of a T, a relatively small opening is provided, such that it helps in pushing out the medicament, but the rest of the base sublayer comprises a contiguous sheet which must be torn when the medicament is pushed out. The resulting resistance makes it more difficult for children to accidentally push the medicament out of the blister or to open it without authorization.

In one alternative embodiment, the T-shaped opening cuts are arranged in a corner of a medicament trough of an individual packaging, especially if the medicament trough does not have a circular configuration. The above-mentioned advantages similarly apply here.

In practice, it has been found that the ratio of the vertical portion to the horizontal portion should be between 0.3 and 2 in order to offer sufficient resistance while still enabling weaker persons to remove the medicaments.

In one very particularly preferred embodiment, a cover sheet, which is at least mostly detachable, is attached to the base sublayer. Information pertaining to the medicament can be printed onto said cover sheet. If this cover sheet is configured such that it is re-closable, it is also possible to attain a very neat and tidy appearance of the entire individual packaging, with the result that the individual packaging according to the invention has a pleasing appearance even after repeated use.

BRIEF DESCRIPTION OF THE DRAWINGS

Further advantages of the safety label according to the invention can be gathered from the attached drawing and the embodiments described below. The abovementioned features and those described below can also be used, according to the invention, in each case individually or together in any desired combinations. The embodiments mentioned should not be understood to constitute a complete list but rather have an exemplary character.

DESCRIPTION OF PREFERRED EMBODIMENTS

Figure 1:
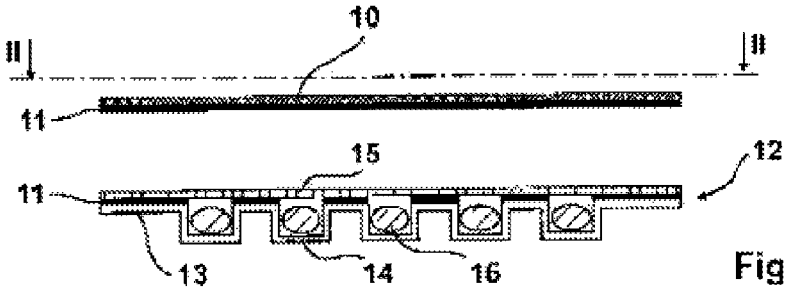
FIG. 1 shows an exploded view, illustrated in section, of a first embodiment of a safety label according to the invention with blister packaging, cut along line I-I in FIG. 2.
Figure 2:
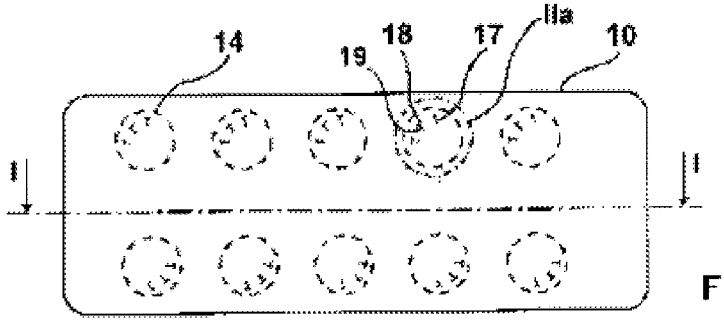
FIG. 2 shows a plan view of the safety label according to FIG. 1.
Figure 2A:
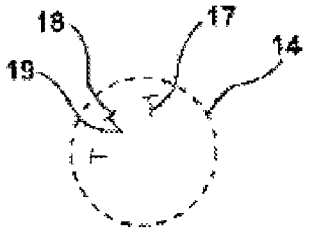
FIG. 2*a* shows a detail enlargement of the safety label along line IIa in FIG. 2.

FIG. 1, FIG. 2 and FIG. 2*a* illustrate a first embodiment of a safety label according to the invention, which comprises a base sublayer 10, on the underside of which adhesive 11 is applied so that this safety label can be adhesively bonded to an individual packaging 12, for example to a blister. The individual packaging 12 comprises a medicament receiving means 13, formed from a dimensionally stable plastic, with a number of medicament troughs 14 and an aluminum foil 15, which is adhesively bonded thereto and by means of which the individual medicaments 16 can be packaged in a sterile manner.

In the base sublayer 10, T-shaped opening cuts 17, which are arranged on a virtual circular path (not illustrated here in more detail), are provided, wherein in this embodiment three T-shaped opening cuts 17 are provided for each medicament trough 14. In this case, T-shaped opening cuts 17 are arranged by their horizontal portion 18 tangentially on the virtual segment of a circle, while the vertical portions 19 of the T-shaped opening cut 17 are oriented radially toward the center of the medicament trough. The three T-shaped opening cuts 17 provided here are in this case arranged equidistantly on the virtual circular path such that the vertical portions 19 of the two outer ones of the opening cuts 17 are arranged quasi perpendicular to one another.

The virtual segment of a circle (not included in the drawing) is arranged concentrically to the edge of the medicament trough 14, which edge is illustrated here by way of a dashed line, wherein the distance between the virtual segment of a circle and the edge of the medicament trough 14 is chosen such that the medicament 16, when it is pushed out in the region of the virtual segment of a circle, presses against the aluminum foil 15 and thus also against the base sublayer 10.

In one other embodiment (not illustrated here), only a single T-shaped opening cut is provided for each medicament. In yet another embodiment (not illustrated here), it is also possible for two, four or five T-shaped opening cuts to be provided per medicament. This depends in particular on the resistance desired by the manufacturer, because the resistance encountered when the medicament is pushed out decreases with the number of the T-shaped opening cuts.

The individual packaging mentioned here can be, for example, a blister or a wallet, but also any other packaging of medicaments in which the medicaments are accommodated individually in a specified cavity.

In the first embodiment illustrated here, the vertical portions 19 are configured to be just as long as the horizontal portions 18, with the portions 18, 19 being configured to be so small that adjacent opening cuts 17 have a clear distance between each other. This distance should be at least half the length of a horizontal portion 18, as a result of which the vertical portion 19 is also oriented in the direction of the center point of the medicament trough 14, while, however, keeping a clear distance from it.

When the medicament 16 is pushed out of the individual packaging 12, the aluminum foil 15 and the base sublayer 10 must be pierced. If an attempt is made to push the medicament through in a region in which no T-shaped opening cuts 17 are provided, a patient of normal strength will not succeed. However, if the medicament 16 is pushed through in the region of the T-shaped opening cuts 17, the resistance at this point is lowered and thus a patient of normal strength will succeed in piercing the aluminum foil 15 and the regions of the base sublayer 10 remaining outside the opening cuts in order to remove the medicament 16. In this manner, a certain resistance to removal of the medicament 16 by children is attained and also accidental pushing through of the medicaments 16 becomes nearly impossible.

Figure 3:
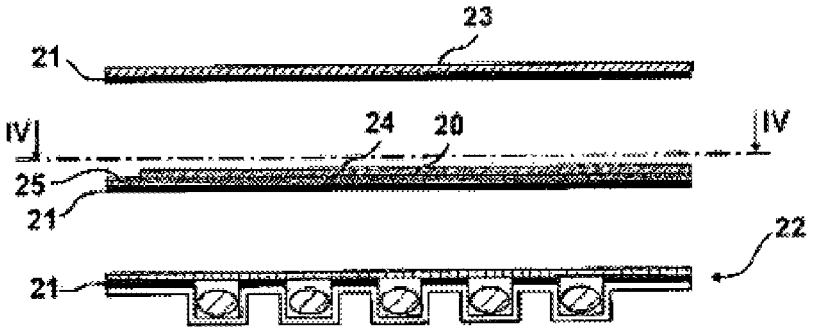
FIG. 3 shows an exploded view, illustrated in section, of a second embodiment of a safety label according to the invention with blister packaging, cut along line III-III in FIG. 4.
Figure 4:
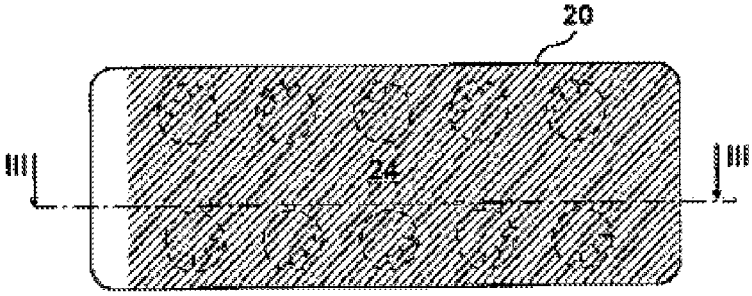
FIG. 4 shows a plan view of the safety label according to FIG. 3 along line IV-IV in FIG. 3.

The second embodiment illustrated in FIG. 3 and FIG. 4 of a safety label according to the invention is identical to the first embodiment illustrated in FIG. 1 and FIG. 2 insofar as the base sublayer 20 and the individual packaging 22 are concerned. However, in this second embodiment a cover sheet 23 is additionally provided, which is adhesively bonded flush on the base sublayer 20. In addition, a silicone layer 24 is applied on the base sublayer 20, except for on a band 25, so that the cover sheet 23 can be opened several times and subsequently closed again reliably.

Figure 5:
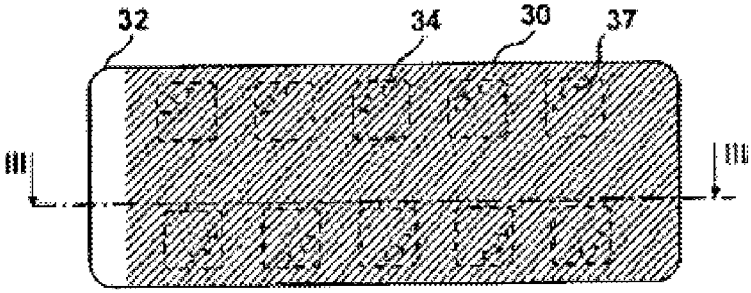
FIG. 5 shows a plan view of a third embodiment of a safety label according to the invention.

The third embodiment illustrated in FIG. 5 differs from the first embodiment illustrated in FIG. 1 and FIG. 2 merely in that here the medicament trough 34 of the individual packaging 32 is not circular but approximately square. Accordingly the opening cuts 37 arranged in the base sublayer 30 are arranged on a virtual segment of a circle in a corner of the medicament trough 34. The statements made regarding the pushing-out of the medicament similarly apply here.

FIG. 6 to FIG. 15 illustrate further embodiments of the safety label, which differ from the first embodiment illustrated in FIG. 1 to FIG. 2*a*, for example, merely by way of an opening cut of different configuration.

Figure 6:
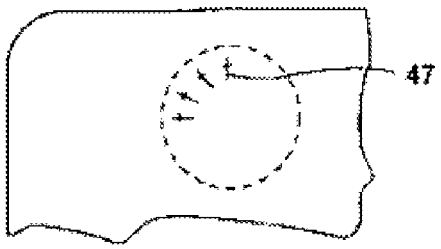
FIG. 6 shows a plan view of a fourth embodiment of a safety label according to the invention.

In the fourth embodiment illustrated in FIG. 6, the opening cuts 47 are configured as an erect "t."

Figure 7:
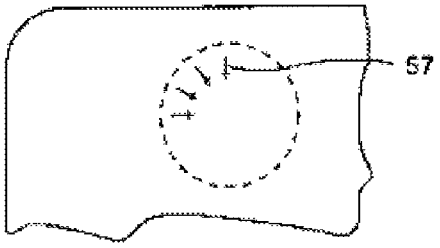
FIG. 7 shows a plan view of a fifth embodiment of a safety label according to the invention.

In the fifth embodiment illustrated in FIG. 7, the opening cuts 57 are configured as an upside-down "t."

Figure 8:
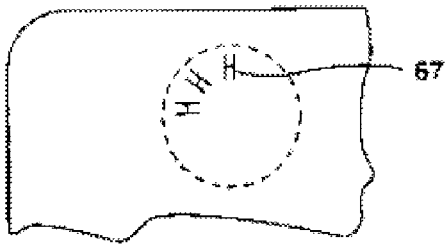
FIG. 8 shows a plan view of a sixth embodiment of a safety label according to the invention.

In the sixth embodiment illustrated in FIG. 8, the opening cuts 67 are configured as an "H."

Figure 9:
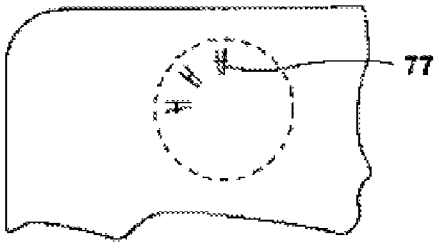
FIG. 9 shows a plan view of a seventh embodiment of a safety label according to the invention.

In the seventh embodiment illustrated in FIG. 9, the opening cuts 77 are configured as an "H with conically tapering vertical bars."

Figure 10:
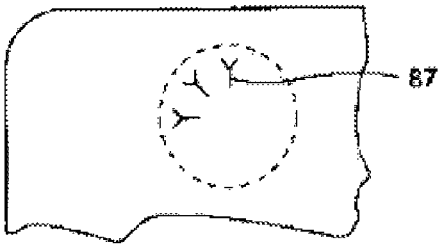
FIG. 10 shows a plan view of an eighth embodiment of a safety label according to the invention.

In the eighth embodiment illustrated in FIG. 10, the opening cuts 87 are configured as an erect "Y."

Figure 11:
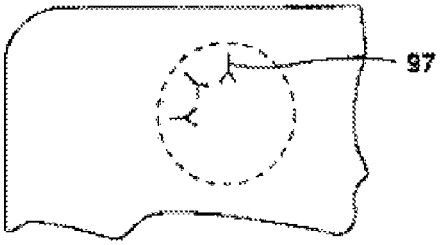
FIG. 11 shows a plan view of a ninth embodiment of a safety label according to the invention.

In the ninth embodiment illustrated in FIG. 11, the opening cuts 97 are configured as an upside-down "Y."

Figure 12:
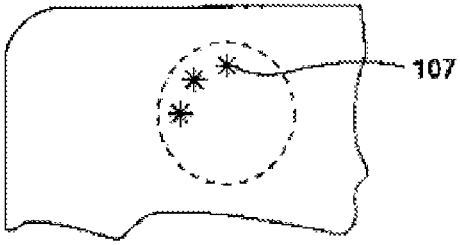
FIG. 12 shows a plan view of a tenth embodiment of a safety label according to the invention.

In the tenth embodiment illustrated in FIG. 12, the opening cuts 107 are configured as a "star."

Figure 13:
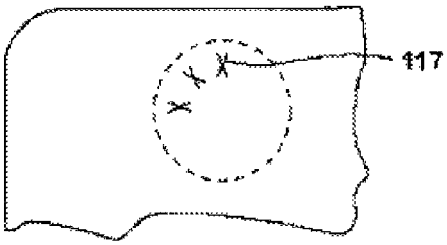
FIG. 13 shows a plan view of an eleventh embodiment of a safety label according to the invention.

In the eleventh embodiment illustrated in FIG. 13, the opening cuts 117 are configured as an "X."

Figure 14:
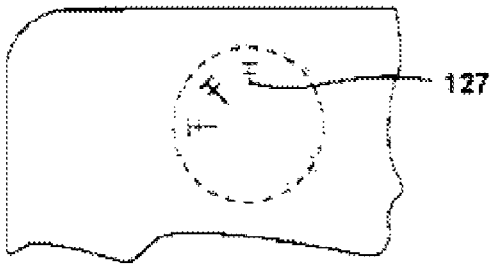
FIG. 14 shows a plan view of a twelfth embodiment of a safety label according to the invention.

In the twelfth embodiment illustrated in FIG. 14, the opening cuts 127 are configured as a "mirrored F."

Figure 15:
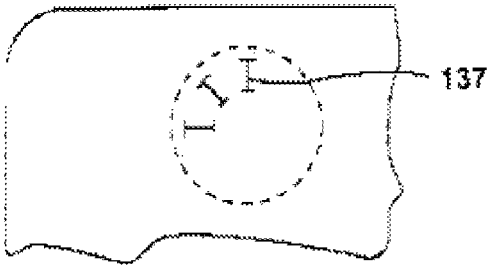
FIG. 15 shows a plan view of a thirteenth embodiment of a safety label according to the invention.

In the thirteenth embodiment illustrated in FIG. 15, the opening cuts 137 are configured as an "I."

Figure 16:
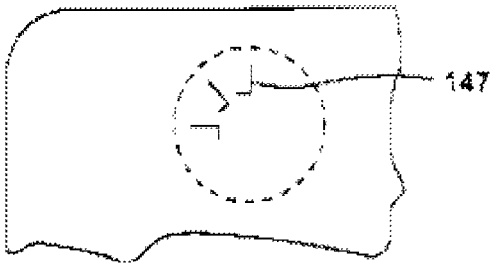
FIG. 16 shows a plan view of a fourteenth embodiment of a safety label according to the invention.

In the fourteenth embodiment illustrated in FIG. 16, the opening cuts are configured as an "L" wherein the lower bar of the "L" is arranged counter-clockwise.

Figure 17:
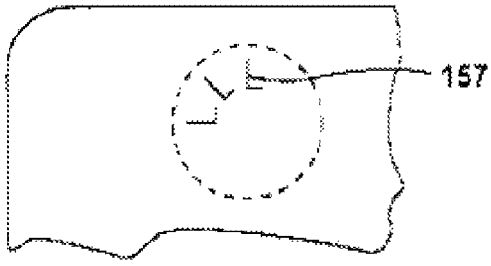
FIG. 17 shows a plan view of a fifteenth embodiment of a safety label according to the invention.

In the fifteenth embodiment illustrated in FIG. 17, the opening cuts are configured as an "L," wherein the lower bar of the "L" is arranged clockwise.

What is claimed is:

1. A safety label configured to protect medicaments, each medicament being contained in a medicament trough in an individual packaging, the safety label having a base sublayer adhesively bonded onto the individual packaging, wherein:

at least two opening cuts are provided in the base sublayer above each medicament to allow removal of each medicament from its individual packaging, each opening cut having at least one first and one second partial cut, the first partial cut and the second partial cut meet or intersect, the at least two opening cuts are arranged in the base sublayer so as to be exclusively located in a single region of the base sublayer, the single region of the base sublayer extending above and along a part of a contour of the medicament or above and along a part of a contour of the medicament trough, and the part is less than or equal to a half of the contour and more than or equal to a sixth of the contour.

2. The safety label as claimed in claim 1, wherein at least three opening cuts are provided in the base sublayer above each medicament and the at least three opening cuts are arranged equidistantly with respect to one another.

3. The safety label as claimed in claim 1, wherein the at least two opening cuts are oriented radially with respect to their virtual center line.

4. The safety label as claimed in claim 1, wherein the at least two opening cuts are arranged such that the region of the base sublayer extends above and along a quarter of the contour, vertical portions of the at least two opening cuts or center points of the at least two opening cuts being arranged above and along an edge of a quarter of the contour.

5. The safety label as claimed in claim 1, wherein each opening cut is configured in a shape of a T, t, H, F, X, Y or a star.

6. The safety label as claimed in claim 5, wherein at least one T-shaped opening cut is arranged with its first, horizontal portion above and along the contour.

7. The safety label as claimed in claim 6, wherein the first, horizontal portion of each T-shaped opening cut bears tangentially above and against the contour, while a second, vertical portion of each T-shaped opening cut is oriented radially in a direction of a center of the medicament trough.

8. The safety label as claimed in claim 7, wherein the vertical portion of each T-shaped opening cut is approximately 0.3 times to twice as long as the horizontal portion of each T-shaped opening cut.

9. The safety label as claimed in claim 1, wherein a cover sheet, which is at least partially detachable, is attached to the base sublayer.

* * * * *